US006318132B1

(12) United States Patent
Gutschmit et al.

(10) Patent No.: US 6,318,132 B1
(45) Date of Patent: Nov. 20, 2001

(54) APPARATUS AND METHOD FOR DETECTING BROKEN HOOKS OF NEEDLES IN A KNITTING MACHINE, AND NEEDLES FOR USE WITH SAME

(75) Inventors: Alan Gutschmit, Troy, NC (US); Bruce M. Pernick, Stamford, CT (US); Paul W. York, Asheboro, NC (US)

(73) Assignee: Monarch Knitting Machinery Corp., Glendale, NY (US)

( * ) Notice: Subject to any disclaimer, the term of this patent is extended or adjusted under 35 U.S.C. 154(b) by 0 days.

(21) Appl. No.: 09/812,045

(22) Filed: Mar. 19, 2001

(51) Int. Cl.[7] ..... D04B 35/10
(52) U.S. Cl. ..... 66/157; 66/165; 66/123
(58) Field of Search ..... 66/157, 161, 163, 66/164, 162, 166, 165, 123, 116

(56) References Cited

U.S. PATENT DOCUMENTS

| | | |
|---|---|---|
| 3,646,542 | 2/1972 | Anthony . |
| 3,659,437 | 5/1972 | McArthur et al. . |
| 3,785,177 | 1/1974 | Hino et al. . |
| 3,904,529 | 9/1975 | Nakamura . |
| 3,905,211 | 9/1975 | Raisin et al. . |
| 3,910,074 | 10/1975 | Parker . |
| 3,937,038 | 2/1976 | Sick . |
| 3,946,578 | 3/1976 | Venczel . |
| 3,987,649 | 10/1976 | Parker . |
| 4,026,128 | 5/1977 | Blanco . |
| 4,027,982 | 6/1977 | Ohishi . |
| 4,270,369 | 6/1981 | Quay et al. . |
| 4,366,681 | 1/1983 | Homocky et al. . |
| 5,524,460 | 6/1996 | Michetti et al. . |
| 6,035,669 | 3/2000 | Gutschmit . |

FOREIGN PATENT DOCUMENTS 2019447 10/1979 (GB) .

*Primary Examiner*—Danny Worrell
(74) *Attorney, Agent, or Firm*—Alston & Bird LLP

(57) ABSTRACT

An apparatus for detecting broken hooks of needles in a knitting machine having first and second cam faces defining a cam for slidably receiving needle butts. The cam includes a raising cam portion, a stitch cam portion, and a welt cam portion in which tension forces between yarn loops and hooks bias the butts of intact needles against the first cam face. The detector has a detector butt raising segment wherein the second cam face in the welt cam portion is inclined away from the second cam face at the stitch position for urging butts toward the first cam face. A detector butt lowering segment follows the detector butt raising segment, in which the first cam face urges the butts toward the second cam face. A recess segment follows the butt lowering segment. The recess is formed so that the second cam face is sufficiently spaced from the first cam face so that butts of needles having broken hooks are urged into the recess segment by the detector butt lowering segment, but butts of intact needles that are biased against the first cam face do not enter the detector recess segment. A sensor identifies terminating ends of needles whose butts are in the detector recess segment. The apparatus may further include means for stopping operation of the knitting machine when the sensor is activated. A method for detecting broken hooks is also provided, as are needles that are for use with the apparatus.

21 Claims, 8 Drawing Sheets

20

30 12
11
21
33
36
13
13
36
32
22
31
34
CONTROLLER
35

12

11
21
33
13
36
36
32
22
31
22
34
CONTROLLER
35

APPARATUS AND METHOD FOR DETECTING BROKEN HOOKS OF NEEDLES IN A KNITTING MACHINE, AND NEEDLES FOR USE WITH SAME

FIELD OF THE INVENTION

The present invention relates to knitting machines and, in particular, to circular knitting machines of the type that utilize latch needles. More particularly, the invention relates to a system for detecting when hooks on needles in the machine are broken or are otherwise non-functional, and for stopping operation of the machine to prevent fabric defects.

BACKGROUND OF THE INVENTION

In the operation of knitting machines, needles having hooks at one end are moved in reciprocating fashion to engage yarns and to pull them into loops or various structures so as to form a knitted fabric. In general, knitting machines may be classified into two types: flat bed knitting machines and circular knitting machines. In both types of machines, means is provided for urging the needles into reciprocating motion. For example, in many knitting machines the needles are provided with one or more butts that extend from the side of a medial portion of the needle shaft. This butt fits into a cam that has upper and lower faces defining a generally undulating cam track. The cam moves laterally relative to the needles, thus urging the butts to follow the cam track and thereby causing the needles to move in translation due to displacement of the cam track.

As the needles move in translation, the hooks on the ends thereof engage yams and manipulate the yams to form a knitted fabric. If the hook on the end of a latch needle is broken or if it fails to engage a yarn, the latch needle can no longer perform the function of forming a loop. If a broken hook is undetected, the circular knitting machine will continue to operate, but the broken hook will cause a continuing defect in the knitted fabric. These defects are unacceptable in the knitted product and therefore result in loss of salable knitted fabric. It is therefore desirable to provide a system for detecting when a needle hook is broken or otherwise nonfunctional and to stop operation of the knitting machine soon after the broken hook is detected so that the broken needle may be replaced.

Apparatus and methods for detecting and reducing fabric defects for use with circular knitting machines are known. For example, U.S. Pat. No. 3,785,177 (the "Hino patent") shows a device for sensing a broken yarn of a circular knitting machine. As an initial matter, the invention in the Hino patent is addressed to broken yarns, and not to broken hooks. Detecting broken yarns is particularly important in knitting machines for producing underwear and undergarments. In the Hino patent, the sensor and associated cam structure are positioned at the base of a stitch cam. Importantly, positioning of the sensor at the base of a stitch cam requires some spacing in the cam for the free deflection of needles with broken hooks or yarns. Placing the sensor at the bottom of the stitch cam, with the corresponding free space required, is impractical in modern high-speed knitting machines, which require very accurate and precise control of the needle butt during the stitch-forming process.

Other references show various apparatus and methods for detecting broken hooks in latch needles in knitting machines. Many of the references focus their detecting devices at or near the hook portion of the needle rather than at the butt portion of the needle. For example, U.S. Pat. No. 3,659,437, MacArthur et al., shows a defective needle detector that uses a beam of collimated energy directed to the hook end of the needles to detect the presence or absence of hooks. Alternatively, a magnet with a piece of electrical crystal may be mounted in the proximity of the needle hooks.

U.S. Pat. No. 3,904,529, Nakamura, shows an apparatus for detecting defective needles which uses an optical fiber having an end disposed so as to detect light reflections from hooks or latch portions of needles in a similar manner to MacArthur et al.

U.S. Pat. No. 3,905,211, Raisin, et al., shows another detector apparatus using magnetic detectors on a hosiery loom. This system employs a magnetic detector mounted to the outside of the loom, and the detector analyzes the entire needle rather than focusing on the needle hook.

The above-described attempts to detect broken needles and to stop operation of the machine can be characterized as failing to provide for high speed operation while simultaneously maintaining precise accurate control of needles as they pass through the stitch cam. In contrast, U.S. Pat. No. 6,035,669 to Alan Gutschmit (the "Gutschmit patent") and owned by Monarch Knitting Machinery Corp. discloses an embodiment for detecting broken hooks of needles in a knitting machine while providing for high speed operation and maintaining precise accurate control of the needles as they pass through the stitch cam, as described in the remainder of this paragraph. First and second cam faces define a cam for slidably receiving needle butts. The cam includes a raising cam portion, a stitch cam portion, and a gate cam portion (e.g., welt-cam portion) in which tension forces between yam loops and hooks bias the butts of intact needles against the first cam face. The detector has a detector butt raising segment wherein the second cam face in the gate cam portion is inclined away from the second cam face at the stitch position for urging butts toward the first cam face. A detector butt lowering segment follows the detector butt raising segment, in which the first cam face urges the butts toward the second cam face. A recess segment follows the butt lowering segment. The recess is formed so that the second cam face is sufficiently spaced from the first cam face so that butts of needles having broken hooks are urged into the recess segment by the detector butt lowering segment, but butts of intact needles that are biased against the first cam face do not enter the detector recess segment. A sensor identifies butts of broken needles in the detector recess segment. The apparatus may further include means for stopping operation of the knitting machine when the sensor is activated. A method for detecting broken hooks is also provided. The Gutschmit patent is incorporated herein by reference.

Whereas the specific embodiment described in the Gutschmit patent provides great advances in that it can detect a broken needle and stop operation of a knitting machine while facilitating high speed operation and simultaneously maintaining precise accurate control of needles as they pass through the stitch cam, it would require a sensor for each cam of a knitting machine having multiple cams for respectively causing the needles to reciprocate. In knitting machines having multiple cams for causing the needles to reciprocate, the butts of different needles are received in and driven by the different cam tracks. It can be disadvantageous to have to mount, align and maintain multiple sensors for detecting broken needles in a machine having multiple cams for respectively causing the needles to reciprocate. Accordingly, there is a need in the art for methods and apparatus that, in addition to providing for high speed operation while simultaneously maintaining precise accurate control of needles as they pass through the stitch cam, can provide for the efficient detection of broken hooks in a knitting machine having multiple cams for causing the needles to reciprocate. Likewise there is a need in the art for needles for use with the needed methods and apparatus.

SUMMARY OF THE INVENTION

Apparatus is provided for detecting broken hooks of needles in a knitting machine having first and second cam faces defining a cam for slidably receiving needle butts. The cam includes a raising cam portion for moving the needles to a raised position for receiving yams, a stitch cam portion following the raising cam portion for moving the needles to a stitch position for making yam loops, and a welt cam portion following the stitch cam portion in which tension forces between the yarn loops and needle hooks bias the butts of intact needles against the first cam face. The detector apparatus has a detector butt raising segment in the welt cam portion wherein the second cam face in the welt cam portion is inclined away from the second cam face at the stitch position for contacting butts and urging the butts toward the first cam face. A detector butt lowering segment is located in the welt cam portion following the detector butt raising segment, wherein the first cam face contacts the needle butts and urges the butts toward the second cam face. A detector recess segment in the welt cam portion follows the detector butt lowering segment, so that the second cam face is sufficiently spaced from the first cam face so that butts of needles having broken hooks are urged into the recess segment by the detector butt lowering segment, but butts of intact needles that are biased against the first cam face do not enter the detector recess segment. A sensor is provided for identifying needles having butts that travel into the detector recess segment, and the sensor is located outside of the detector recess segment. More specifically, the sensor is located outside of the cam track, which is defined between the first and second cam faces that define the cam. Most specifically, the sensor is arranged for identifying terminating ends of needles having butts that travel into the detector recess segment. For each needle, the terminating end is preferably opposite from the hook end thereof. The apparatus may further include means for stopping operation of the knitting machine when the sensor detects a needle whose butt is in the detector recess segment. In accordance with one aspect of the present invention, a multi-track knitting machine advantageously includes a single sensor for identifying broken needles that travel in any one of multiple cam tracks.

In accordance with one aspect of the present invention, the multiple needles are respectively contained in multiple trick channels within which the needles reciprocate due to relative movement between the trick channels and the cam (s). The sensor includes a blade that is positioned so as to be activated by the terminating ends of broken needles that protrude from their respective trick channels. In accordance with this aspect, the needles are constructed so that while operating to knit fabric their terminating ends activate the sensor solely when their hooks break. The sensor may include an electrical switch that is tripped by movement of the blade.

Also provided is a method for identifying broken hooks of needles in a knitting machine. The method includes providing a welt cam having first and second cam faces for controlling the position of needles in a knitting machine so that intact needles are biased against the first cam face by tension forces between the needle hooks and yams; contacting the needle butts with an inclined portion of the second cam face to urge the butts toward the first cam face; contacting the needle butts with a declined portion of the first cam face to urge the butts toward the second cam face; providing a detector recess segment in which the second cam face is sufficiently spaced from the first cam face so that butts of needles having broken hooks enter the recess due to contact with the declined portion of the first cam face; sensing with a sensor that is positioned outside of the detector recess segment the existence of a needle having its butt in the detector recess segment; and stopping operation of the knitting machine when the sensor is actuated. Preferably the sensor is positioned so as to be activated by a terminating end of a broken needle that is originally opposite from the hook end of the broken needle.

Also provided are needles for use with a circular knitting machine that incorporates the combination of the detector apparatus and the sensor for detecting broken hooks of needles. In accordance with one aspect of the present invention and for each needle, the terminating end is constructed so that it is precluded from triggering the sensor while the needle is intact and used in the knitting machine to form fabric, and the terminating end triggers the sensor while the needle is used in the knitting machine and the hook of the needle is broken. In accordance with another aspect of the present invention, each needle defines a length between its hook and terminating ends, and the terminating end extends generally parallel to the length. In accordance with another aspect of the present invention, for each needle the terminating end extends generally perpendicular to its length.

Generally described, each needle can be characterized as including sensor triggering means for triggering a sensor for detecting broken needles in a circular knitting machine, and in accordance with some embodiments the triggering means is a terminating end of the needle that is opposite from the hook end. In a set of needles that is for use with a multi-track circular knitting machine, there is a separate group of needles for each track. Needles of different groups have different butt positions.

BRIEF DESCRIPTION OF THE DRAWINGS

The above and other features and advantages of the present invention will become apparent from the following description taken in conjunction with the accompanying drawings, in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth; rather, the set forth embodiments are provided so that this disclosure will be thorough and complete, and will fully convey the scope of the invention to those skilled in the art. Like numbers refer to like elements throughout.

Figure 1:
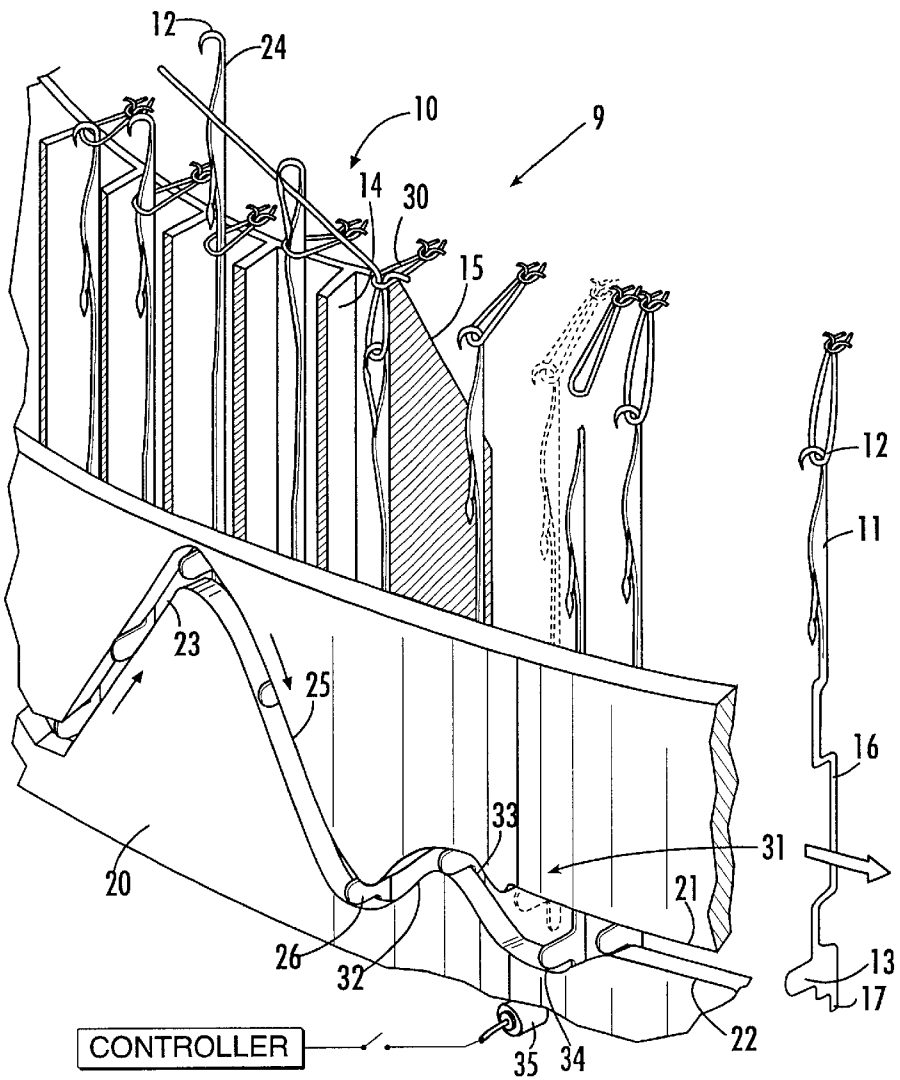
FIG. 1 is an environmental perspective view showing a portion of a cylinder-type circular knitting machine, in accordance with a first embodiment of the present invention.

Referring now to FIG. 1, designated generally as 10 is a portion of the cylinder 15 and cylinder cam 20 of a cylinder-type circular knitting machine 9. Needles 11 having hooks 12 and butts 13 are positioned in trick channels 14 of the knitting machine cylinder 15 so as to be arranged for translational motion in the direction of the needle shaft 16. Each needle 11 also includes a terminating end 17 that is opposite from the end with the hook 12. In accordance with the first embodiment, the hooks 12 protrude from open upper ends of the trick channels 14 and at least the terminating ends 17 of needles 11 with broken hooks protrude from open lower ends of the trick channels, as will be discussed in greater detail below. Also in accordance with the first embodiment, the terminating ends 17 of the needles 11 extend downward, parallel to the axis of rotation of the cylinder 15. Further in accordance with the first embodiment, each needle 11 defines a length between its hook 12 and terminating end 17, and the terminating end extends generally parallel to the length.

The cam 20 is positioned around the outer periphery of the cylinder 15. First and second faces 21 and 22 of the cam 20 (shown herein as upper and lower faces, respectively) define a track of the cam 20 through which the needle butts 13 are slidably received. The cam 20 and cylinder 10 move rotationally past each other so that the butts 13 are forced up and down due to displacement of the cam track defined by the faces 21 and 22 of the cam 20.

The cam 20 includes a needle raising portion 23, which as shown in FIG. 1 raises the needles to a raised position 24. When the needles are in the raised position, the hooks 12 thereof may receive a new yam to be knitted. Following the raising cam portion 23 in the cam 20 is a stitch cam portion 25. The stitch cam portion 25 moves the needles downwardly, away from the needle raising position 24, and ultimately to a stitch position 26. When the needles 11 are in the stitch position, the hooks engage loops 30 of the knitted fabric being formed by the machine. Tension in the knitted loops 30 tends to pull the needles upwardly against the upper or first cam face 21 when the needles are in or near the stitch position 26.

A welt cam portion 31 of the cam 20 follows the raising portion 23 and the stitch portion 25 (note that the needles move through the cam track in the direction of the arrows in FIG. 1). According to one aspect, the welt cam portion 31 can more specifically be a gate cam portion. The configuration of the cam track defined by the upper and lower faces 21 and 22 of the welt cam portion 31 is such that the butts 13 of intact needles 11 are biased against the upper or first face 21 by tension between the hooks 12 and yam loops 30. In the welt cam portion 31, a detector butt raising segment 32 is provided following the stitch position 26 formed by the stitch cam 25. This detector butt raising segment 32 in the welt cam portion 31 is inclined away from the second cam face 22 at the stitch position 26. The detector butt raising segment 32 contacts the butts 13 of the needles and urges them upwardly, in the direction of the first cam face 21. This portion provides for accurate control of the needle butts 13 as they leave the stitch position 26.

Following the detector butt raising segment 32 is a detector butt lowering segment 33, which is formed in the upper or first face 21 of the cam 20. The detector butt lowering segment 33 contacts the butts 13 as they move past the butt raising segment 32 and urges the butts downwardly again in the direction of the second or lower cam face 22.

Partially underlying and following the detector butt lowering segment 33 is a detector recess segment 34. The detector recess segment 34 is formed in the lower or second cam face 22 in the welt cam portion 31. In the recess segment 34, the second or lower cam face 22 is sufficiently spaced away from the upper or first cam face 21 so that the motion of butts 13 of defective needles is distinct from the motion of butts of intact needles 11, as will be discussed in greater detail below with reference to FIGS. 2–3. For each needle 11, the motion of the terminating end 17 is dictated by the motion of the butt 13. Accordingly, due to the structure of the recess segment 34 of the cam 20 and the structures of the cam that are just upstream from the recess segment, the motion of the terminating end 17 of a defective needle with respect to the recess segment 34 is distinct from the motion of the terminating end 17 of an intact needle with respect to the recess segment 34. In accordance with the first embodiment, a sensor 35 is positioned so that the terminating ends of 17 of defective needles passing through the recess segment 34 are detected by the sensor 35, and the terminating ends 17 of the intact needles passing by the recess segment 34 are not detected by the sensor 35. Accordingly and in accordance with the first embodiment for each needle 11, the terminating end 17 can be characterized as triggering means for triggering the sensor if the needle is broken. Other triggering means are also within the scope of the present invention.

In accordance with the first embodiment, conventional needles are preferably not used in the circular knitting machine 9. Rather, in accordance with the first embodiment, the lengths of the terminating ends 17 of the needles 11 are selected so that they optimally interact with the blade (for example, see the blades 38*a–d* illustrated in FIGS. 5–8, respectively) of the sensor 35 when the butts 13 thereof are in or in the vicinity of the recess segment 34, as will become apparent from the following.

Figure 2:
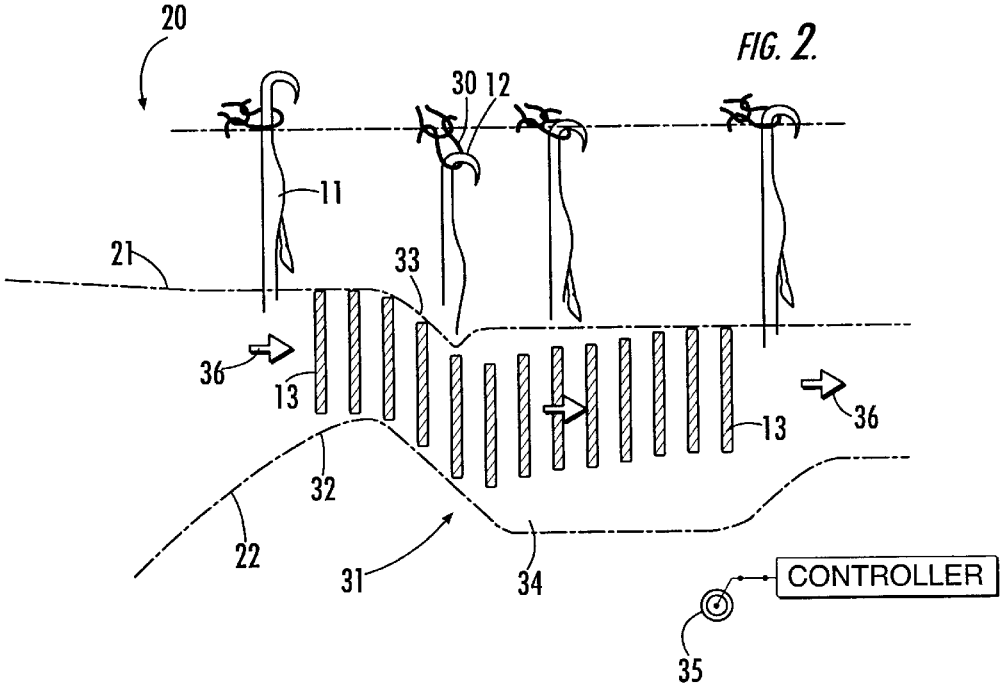
FIG. 2 is a partially schematic, side elevation view illustrating the motion of intact needles through the cam of the circular knitting machine of FIG. 1, in accordance with the first embodiment.

Referring now to FIG. 2, one aspect of the first embodiment is shown in a partially schematic view which shows portions of a plurality of intact needles 11, cross sections of needle butts 13 of intact needles, and the first and second cam faces 21 and 22 within the welt cam portion 31 of the cam 20. The direction of motion of the butts 13 through the welt cam 31 is indicated by arrows 36. As mentioned above, the motion of terminating ends 17 (FIG. 1) of intact needles 11 is dictated by the motion of the butts 13 of the intact needles. As indicated in FIG. 2, the detector butt raising portion 32 ensures that the butts 13 are positioned adjacent the upper or first face 21 as the needles move towards the detector butt lowering segment 33. Upon encountering the detector butt lowering segment 33, the butts are urged downwardly, in the direction of the second or lower face 22. At this point, tension forces between the hooks 12 of the needles and knitted yarn loops 30 tend to pull the needles upwardly, thus biasing them against the first cam face 21. Thus, as shown in FIG. 2, as the butts 13 move past the detector butt lowering segment 33 they are pulled upwardly by these tension forces so as to move once again into contact with the first or upper cam face 21. As shown in FIG. 2, it is possible that immediately after leaving the detector butt lowering segment 33, the butts 13 may not remain in contact with the upper face 21; however, in this event the butts are sufficiently restrained by the tension forces between the hooks 12 and yarn loops 30 that they do not enter the detector recess segment 34, and they soon reestablish contact with the first face 21. Thus, the terminating ends 17 of the intact needles 11 do not actuate the sensor 35.

Figure 3:
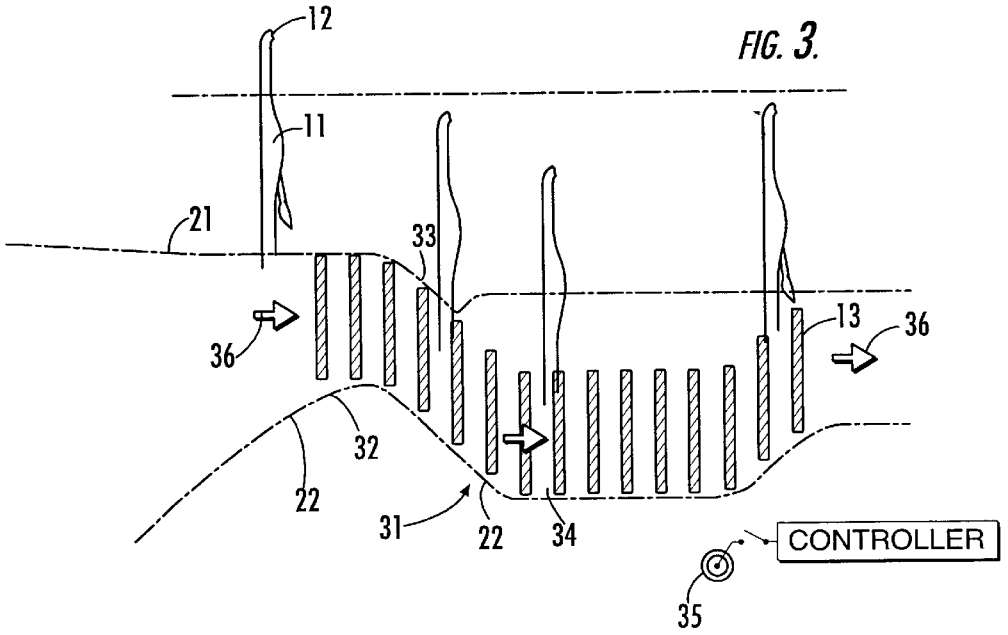
FIG. 3 is a partially schematic, side elevation view illustrating the motion of defective needles through the cam the circular knitting machine of FIG. 1, in accordance with the first embodiment.

The motion of the butts 13 of needles 11 having broken hooks 12 is illustrated in FIG. 3. As mentioned above, the motion of the terminating ends 17 (FIG. 1) of defective needles is dictated by the motion of the butts 13 of the broken needles. In this view, the butts 13 initially pass by the detector butt raising segment 32 and may be engaged by that segment to ensure that the butts 13 are in contact with the upper face 21 of the welt cam portion 31. The butts 13 next encounter the detector butt lowering segment 33, which urges the butts downwardly, in the direction of the second or lower face 22. However, due to the broken hooks 12, there are no tension forces between any portion of the needle and the knitted yarn loops 30 or fabric which tend to pull the needle upwardly. Thus, the needle butts 13 are urged by the detector butt lowering segment 33 into the detector recess segment 34. As the needle butts 13 of the defective needles 11 continue on their path through the recess segment 34, the terminating ends 17 of the defective needles pass along a corresponding path and the sensor 35 detects the presence of those terminating ends.

Referring now to FIGS. 2 and 3 collectively, it is seen that actuation of the sensor 35 by the presence of terminating ends 17 (FIG. 1) being proximate thereto, which results from corresponding needle butts 13 being within the detector recess 34, actuates a controller. The controller may provide an output for giving an operator an indication of a fabric and/or needle defect. Alternatively, the controller may automatically stop operation of the knitting machine so that the defect may be corrected, such as by removing the needle having a broken hook 12 and replacing it with a new needle.

Figure 4:
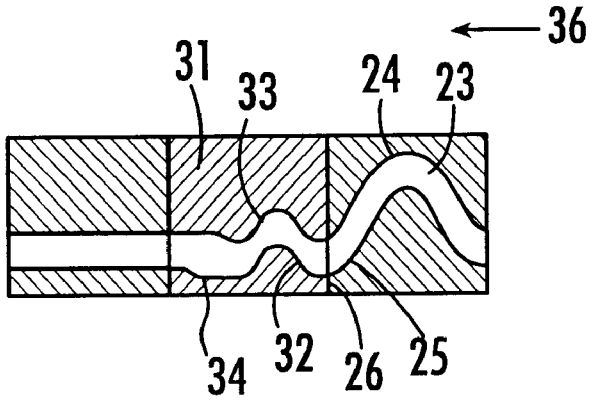
FIG. 4 is a schematic elevation view of stitch and welt cam portions of the cam of the circular knitting machine of FIG. 1, in accordance with first embodiment.

FIG. 4 is a schematic elevation view of needle raising and stitch cam portions 23, 25, and a welt cam portion 31. As indicated therein, the needles moving in the direction 36 move past the raising cam portion 23 to a raised position 24, and thereafter into the stitch cam portion 25 to the stitch position 26. Thereafter, the needles move into the welt cam portion 31, and in the welt cam portion encounter the butt raising segment 20 32, butt lowering segment 33 and recess segment 34.

Referring to FIGS. 1, 2 and 3, in accordance with the first embodiment, the sensor 35 includes a blade or tip (for example, see the blades 38*a–d* illustrated in FIGS. 5–8, respectively) that projects beneath the cam 20 and is in vertical alignment with the detector recess segment 34. When the blade of the sensor 35 is contacted by needle terminating ends 17, it may actuate a switch that controls an electrical circuit tied to the driving means for the knitting machine 9. Alternatively, any of a variety of other sensor means may be used, as desired, for identifying needles whose butts are within the recessed segment 34. For example, it is envisioned that an electrical contact, laser or photo-electric sensor means might be provided to identify the terminating ends 17 or other portions of needles whose butts 13 pass through the recess segment 34. Other variations will be seen by persons of ordinary skill in the art and are encompassed by the scope of this invention.

Referring to FIG. 1, a method for identifying broken hooks of needles in a knitting machine is also provided. The method includes providing a welt cam portion 31 having first and second cam faces 21 and 22 for controlling the position of needles 11 in a knitting machine 10 so that intact needles are biased against the first cam face 21 within the welt cam portion 31 by tension forces between the needle hooks 13 and knitted fabric or yarns 30. The needle butts 13 in the welt cam portion 31 are contacted first by an inclined portion 32 of the second cam face 22 in the welt cam portion 31 (i.e., the detector butt raising segment 32) to urge the butts 13 towards the first cam face 21. Next, the needle butts 13 are contacted by the declining, or detector butt lowering segment 33, of the first cam face 21 to urge the butts 13 towards the second cam face 22. Next, the butts 13 are moved past a detector recess segment 34. Contact between the declining or butt lowering segment 33 causes the needle butts 13 to move in the direction of the recessed segment 34; however, only butts of needles 11 with broken or otherwise nonfunctioning hooks 12 enter the recessed segment 34. The next step is sensing with the sensor 35 the needles whose butts 13 are in the detector recess segment 34, such as by sensing the terminating ends 17 thereof, as described above. The method also includes stopping operation of the knitting machine when the sensor is actuated.

Figure 5A:
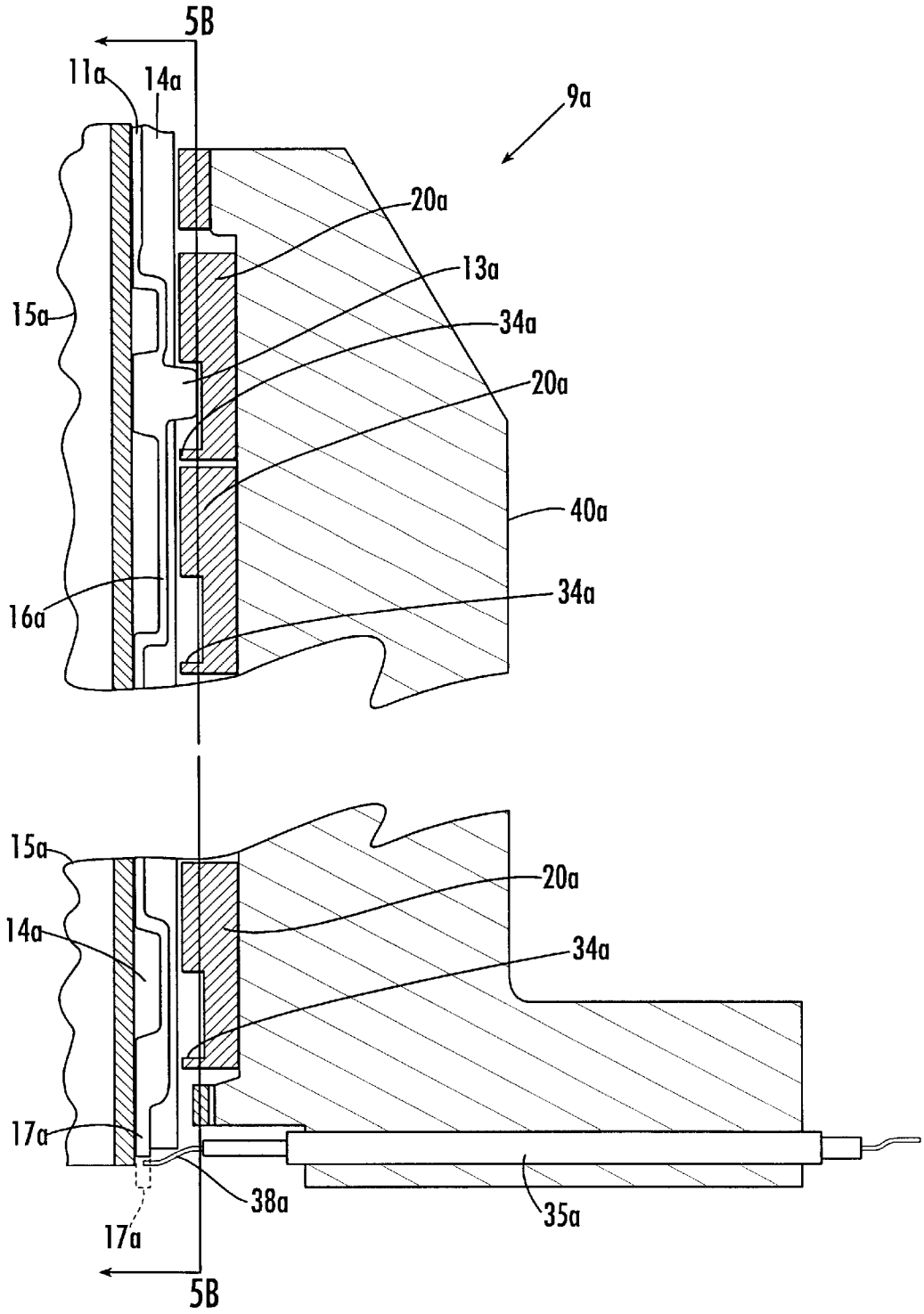
FIG. 5A is a partially schematic, vertically sectioned view of a portion of a cylinder-type, multi-track, circular knitting machine, in accordance with a first example of a second embodiment of the present invention.

FIG. 5A illustrates portions of a cylinder-type circular knitting machine 9*a*, in accordance with a first example of a second embodiment of the present invention. The knitting machine 9*a* of the first example of the second embodiment, including its needles, is identical to the knitting machine 9 of the first embodiment, except for variations noted and variations that will be apparent to those of ordinary skill in the art.

In accordance with the first example of the second embodiment, the knitting machine 9*a* preferably includes multiple cams 20*a* that are positioned one above the other and are carried by and stationary with respect to a cam-carrying structure 40. In accordance with the first example of the second embodiment, each of the cams 20*a* includes a welt cam portion at least generally like the welt cam portion 31 (FIGS. 1–4) defined by the cam 20 of the first embodiment, and all of the recessed segments 34*a* of the cams 20*a* are vertically aligned with one another. FIG. 5A is a sectional view resulting from a straight and vertical section having been taken through the recessed segments 34*a* of all of the cams 20*a*.

In accordance with the first example of the second embodiment, the recessed segment 34*a* of each of the cams 20*a* is vertically aligned with the blade 38*a* of the sensor 35*a*, so that a single sensor can advantageously detect broken needles carried by any of the multiple cams 20*a*. Stated differently and in accordance with the first example of the second embodiment, the knitting machine 9*a* preferably includes only a single sensor 35*a* that can detect defective needles carried by any of the cams 20*a*.

In accordance with the first example of the second embodiment, the sensor 35*a* is mounted within a bore that extends through the cam-carrying structure 40*a*. The triggering blade 38*a* of the sensor 35*a* extends to a position below and closely adjacent the trick channel 14*a* that is oriented toward the sensor 35*a*. In accordance with the first example of the second embodiment, the sensor 35*a* is constructed and arranged so that its blade 38*a* is positioned just below the lower opening of the trick channel 14*a* that is oriented toward and rotating past the sensor 35*a*.

As illustrated in FIG. 5A, the butt 13*a* of the generally representative needle 11*a* travels in the cam track defined by the uppermost one of the cams 20*a*. In accordance with the first example of the second embodiment, the following description of the representative needle 11*a* illustrated in FIG. 5A and its interaction with its respective cam 20*a* is generally representative of the other needles and their interaction with the cams 20*a* other than the uppermost cam 20*a*. In accordance with the first example of the second embodiment, the length of the needle 11*a*, or more particularly the length of the terminating end 17*a* thereof, is selected so that the needle interacts with the sensor 35*a* in different ways, depending upon whether the hook of the needle is intact or broken. In accordance with the first example of the second embodiment and as illustrated by solid lines in FIG. 5A, the butt 13*a* of an intact needle 11*a* remains distant from the recess segment 34*a* of the cam 20*a* carrying the needle so that the terminating end 17*a* remains primarily within its trick channel 14*a* and does not trigger the blade 38*a* of the sensor 35*a*. In contrast, and as partially illustrated by the broken line showing of the terminating end 17*a*, the butt 13*a* of a broken needle 11*a* is urged into the recess segment 34*a* of the cam 20*a* carrying the needle, so that the terminating end 17*a* protrudes sufficiently from the lower end of its trick channel 14*a* to trigger the blade 38*a* of the sensor 35*a*.

In accordance with the first example of the second embodiment, the multiple trick channels 14*a* (only one of which is partially shown in FIG. 5A) of the cylinder 15*a* each contain respective needles and each needle includes a single butt that travels within the cam track defined by a respective one of the multiple cams 20*a*. Accordingly, the knitting machine 9*a* will include a number of different types of needles, with the number of different types of needles corresponding to the number of cams 20*a*. For each of the cams 20*a*, the needles carried thereby have terminating ends corresponding in design, placement, and function to the terminating end 17*a* illustrated in and described with respect to FIG. 5A, as should be apparent to those of ordinary skill in the art in view of this disclosure.

Figure 5B:
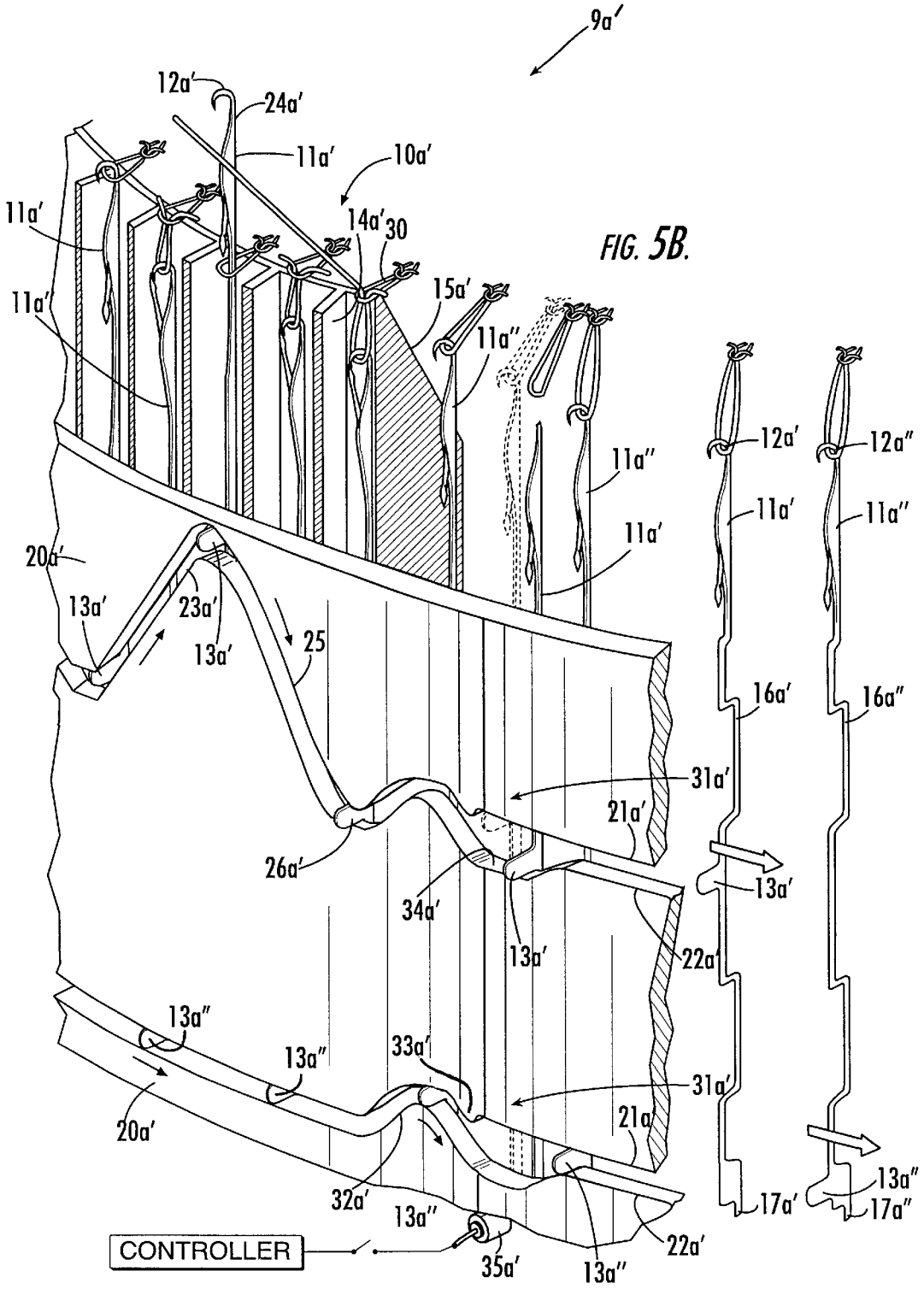
FIG. 5B is an environmental perspective view showing a portion of a cylinder type, multi-track, circular knitting machine, in accordance with a second example of the second embodiment of the present invention, with the cross-sectional line 5B—5B in FIG. 5A providing a general indication of the line of site for FIG. 5B.

FIG. 5B illustrates portions of a cylinder-type circular knitting machine 9*a*', in accordance with a second example of the second embodiment of the present invention. The knitting machine 9*a*' of the second example of the second embodiment, including its needles, is identical to the knitting machine 9*a* of the first example of the second embodiment, except for variations noted and variations that will be apparent to those of ordinary skill in the art. For example, the knitting machine 9*a*' of the second example of the second embodiment includes only two cams 20*a*', which can respectively be referred to as upper and lower cams.

The set of needles that are used with the knitting machine 9*a*' of the second example of the second embodiment includes a first subset of needles 11*a*' and a second subset of needles 11*a*". The butts 13*a*' of the first subset of needles 11*a*' travel in the upper cam 20*a*', and the butts 13*a*" of the second subset of needles 11*a*" travel in the lower cam 20*a*'. Accordingly, for each needle of the first subset 11*a*', the butt 13*a*' is a first distance from the hook 12*a*' of the needle, and for each needle of the second subset 11*a*", the butt 13*a*" is a second distance from the hook 12*a*" of the needle, and the first distance is less than the second distance. Each of the needles of the second example of the second embodiment define the same distance between their opposite ends.

Figure 6:
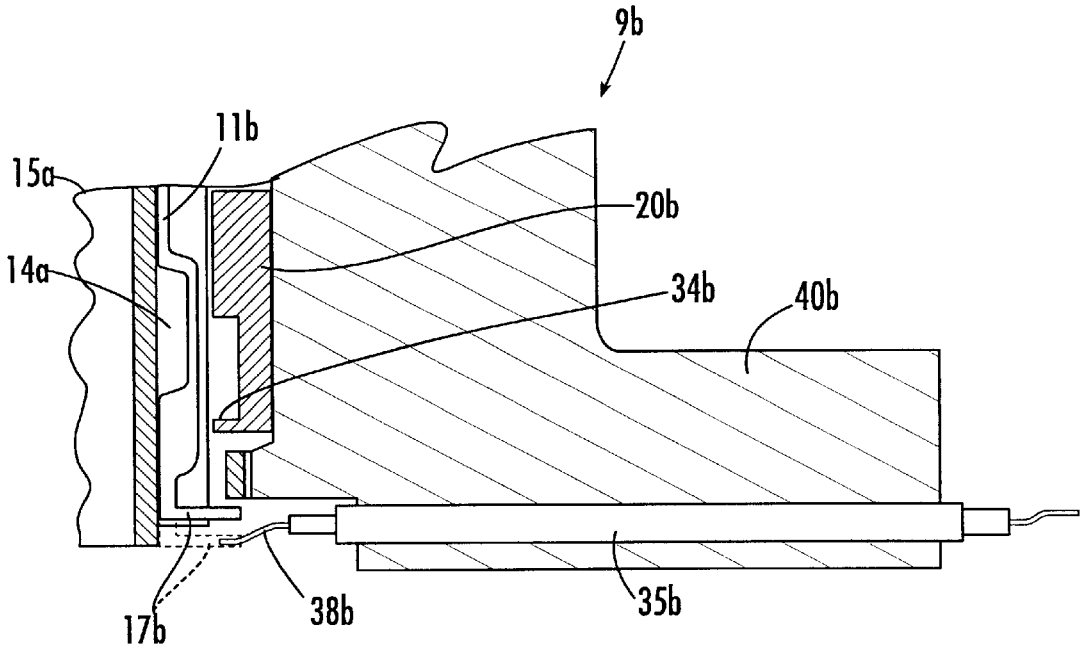
FIG. 6 is a partially schematic, vertically sectioned view of a portion of a cylinder-type, multi-track, circular knitting machine, in accordance with a third embodiment of the present invention.

FIG. 6 illustrates a portion of a cylinder-type circular knitting machine 9*b*, in accordance with a third embodiment of the present invention. The circular knitting machine 9*b* of the third embodiment, including its needles, is identical to the circular knitting machine 9*a* of the first example of the second embodiment, except for variations noted and variations that will be apparent to those of ordinary skill in the art.

In accordance with the third embodiment, the terminating end 17*b* of the generally representative needle 11*b* illustrated in FIG. 6 extends radially outward from its respective trick channel 14*b* because the terminating end extends perpendicular to the axis of rotation of the cylinder 15*b*. In addition, the needle 11*b* defines a length between its hook and terminating end 17*b*, and the terminating end extends generally perpendicular to the length.

In accordance with the third embodiment and as partially illustrated by solid lines in FIG. 6, the butt of an intact needle 11*b* remains distant from the recess segment 34*b* of the cam 20*b* carrying the needle so that the terminating end 17*b* remains spaced apart from the blade 38*b* of the sensor 35*b*. In contrast, and as partially illustrated by the broken line showing of the terminating end 17*b* in FIG. 6, the butt of a broken needle 11*b* is urged to be proximate the recess segment 34*b* of the cam 20*b* carrying the needle, so that the terminating end 17*b* triggers the blade 38*b* of the sensor 35*b*.

Whereas FIG. 6 illustrates that the terminating end 17*b* protrudes slightly from the lower end of the trick channel 14*a* to engage the blade 38*b*, in accordance with the present invention it is not necessary for terminating ends to protrude from the ends of their respective trick channels to engage the blade of the sensor 35*b*. That is, and in accordance with alternative embodiments of the present invention for needles in which the terminating ends thereof extend perpendicularly to the lengths of the needles, the terminating ends can engage the blade of the sensor while extending solely out of the open side portions of their respective trick channels. The side of a trick channel extends between the opposite ends of the trick channel.

As will be apparent to those or ordinary skill in the art, the present invention has applicability to other than cylinder-type circular knitting machines. For example, the present invention has applicability to dial-type circular knitting machines, in which case terms such as "raising" an "lowering," and variants thereof, are to be understood to respectively mean moving away from and toward a central location, such as the center of rotation of the dial.

Figure 7:
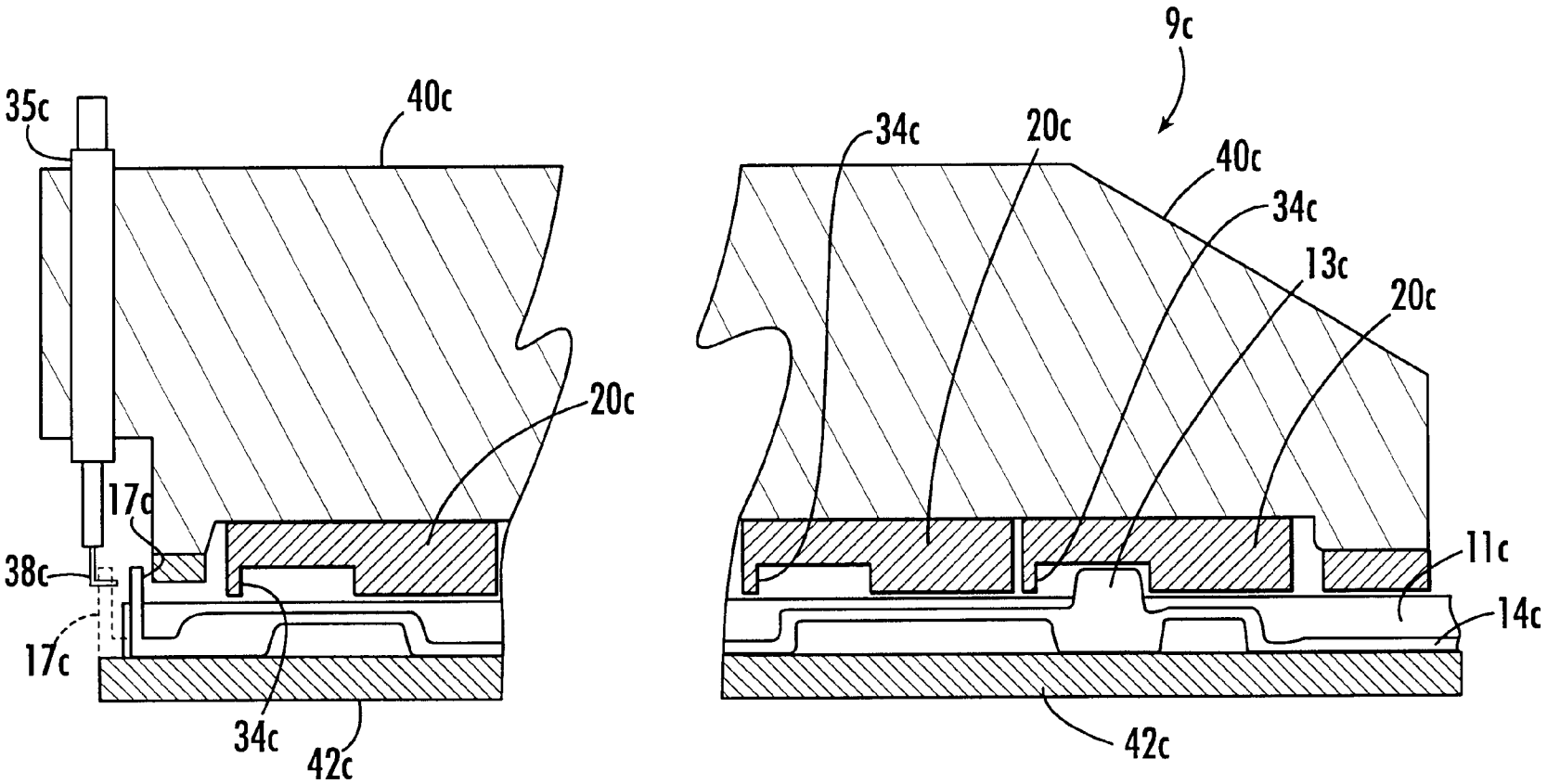
FIG. 7 is a partially schematic, vertically sectioned view of a portion of a dial-type circular knitting machine, in accordance with a fourth embodiment of the present invention.

FIG. 7 illustrates a portion of a dial-type circular knitting machine 9*c*, in accordance with a fourth embodiment of the present invention. The dial-type circular knitting machine 9*c* of the fourth embodiment, including its needles, is like the cylinder-type circular knitting machine 9*b* (FIG. 6) of the third embodiment, except for variations noted and variations that will be apparent to those of ordinary skill in the art, such as orientation variations.

The dial-type circular knitting machine 9*c* includes a generally horizontal rotating dial 42*c* rather than a generally vertically extending rotating cylinder 15*b* (FIG. 6). In addition, in accordance with the fourth embodiment, the multiple cams 20*c* are concentrically positioned a common horizontal plane and are carried by and stationary with respect to the cam-carrying structure 40*c*. In accordance with the fourth embodiment, each of the cams 20*c* includes a welt cam portion at least generally like the welt cam portion 31 (FIGS. 1–4) defined by the cam 20 (FIGS. 1–4) of the first embodiment, and all of the recessed segments 34*c* of the cams 20*c* are radially aligned with one another (i.e., radially aligned with respect to an imaginary radii extending from the common center that the cams 20*c* extend around). FIG. 7 is a sectional view with the straight and vertical section having been taken through the recessed segments 34*c* of all of the cams 20*c*.

In accordance with the fourth embodiment, the recessed segment 34*c* of each of the cams 20*c* is radially aligned with the blade 38*c* of the sensor 35*c*, so that a single sensor can advantageously detect broken needles carried by any of the multiple cams 20*c*. Stated differently and in accordance with the fourth embodiment, the knitting machine 9*c* preferably includes only a single sensor 35*c* that can detect defective needles carried by any of the cams 20*c*.

In accordance with the fourth embodiment, the terminating end 17*c* of the generally representative needle 11*c* illustrated in FIG. 7 extends perpendicular to the length of the needle and out of the upper side of its representative trick channel 14*c*, such that the terminating end extends parallel to the to the axis of rotation of the dial 42*c*. In addition, the needle 11*c* defines a length between its hook and terminating end 17*c*, and the terminating end extends generally perpendicular to the length. The hook of the representative needle 11*c* illustrated in FIG. 7 protrudes from an open inner end of the trick channel 14*c* and the terminating end 17*c* of the representative needle protrudes from the trick channel proximate the outer end of the trick channel.

As illustrated in FIG. 7, the butt 13*c* of the illustrated needle 11*c* travels in the cam track defined by the innermost one of the cams 20*c*. In accordance with the fourth embodiment, the description of the needle 11*c* illustrated in FIG. 7 and its interaction with its respective cam 20*c* and other components is generally representative of the other needles and their interaction with the cams 20*c* other than the innermost cam 20*c*. In accordance with the fourth embodiment, the length of the needle 11*c*, or more particularly the length of the terminating end 17*c* thereof, is selected so that the needle interacts with the sensor 35*c* in different ways, depending upon whether the hook of the needle is intact or broken. In accordance with the fourth embodiment and as illustrated by solid lines in FIG. 7, the butt 13*c* of an intact needle 11*c* remains distant from the recess segment 34*c* of the cam 20*c* carrying the needle so that the terminating end 17*c* remains primarily within its trick channel 14*c* and does not trigger the blade 38*c* of the sensor 35*c*. In contrast, and as partially illustrated by the broken line showing of the terminating end 17*c* in FIG. 7, the butt 13*c* of a broken needle 11*c* is urged to be proximate the recess segment 34*c* of the cam 20*c* carrying the needle, so that the terminating end 17*c* engages the blade 38*c* of the sensor 35*c*.

In accordance with the fourth embodiment, the multiple trick channels 14*c* of the dial 42*c* each contain respective needles and each needle includes a single butt that travels within the cam track defined by a respective one of the multiple cams 20*c*. Accordingly, the knitting machine 9*c* will include a number of different types of needles, namely the number of different types of needles corresponds to the number of cams 20*c*. For each of the cams 20*c*, the needles carried thereby have terminating ends corresponding in design, placement, and function to the terminating end 17*c* illustrated in and described with respect to FIG. 7, as should be apparent to those of ordinary skill in the art in view of this disclosure.

Figure 8:
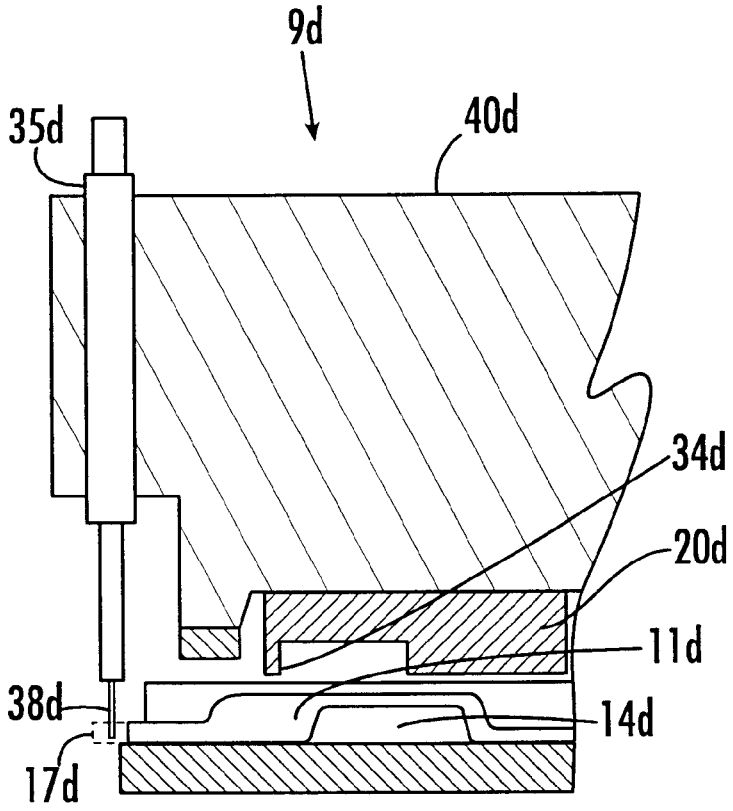
FIG. 8 is a partially schematic, vertically sectioned view of a portion of a dial-type circular knitting machine, in accordance with a fifth embodiment of the present invention.

FIG. 8 illustrates a portion of a dial-type circular knitting machine 9*d* in accordance with a fifth embodiment of the present invention. The circular knitting machine 9*d* of the fifth embodiment, including its needles, is identical to the circular knitting machine 9*c* (FIG. 7) of the fourth embodiment, except for variations that are noted and variations that will be apparent to those of ordinary skill in the art.

The needle 11*d* illustrated in FIG. 8 is generally representative of the multiple needles of the fifth embodiment. The terminating end 17*d* of the needle 11*d* extends radially outward from its respective trick channel 14*b* because the terminating end extends perpendicular to the axis of rotation of the dial 42*d*. In addition, the needle 11*d* defines a length between its hook and terminating end 17*d*, and the terminating end extends generally perpendicular to the length.

In accordance with the fifth embodiment and as partially illustrated by solid lines in FIG. 8, the butt of an intact needle 11*d* remains distant from the recess segment 34*d* of the cam 20*d* carrying the needle so that the terminating end 17*d* remains spaced apart from the blade 38*d* of the sensor 35*d*. In contrast, and as partially illustrated by the broken line showing of the terminating end 17*d* in FIG. 8, the butt of a broken needle 11*d* is urged into the recess segment of the cam 20*d* carrying the needle, so that the terminating end 17*d* triggers the blade 38*d* of the sensor 35*d*.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiment disclosed and that modifications and other embodiments are intended to be included within the scope of the appended claims. Although specific terms are employed herein, they are used in a generic and descriptive sense only and not for purposes of limitation.

That which is claimed:

1. A multi-track knitting machine, comprising:

a plurality of needles, each comprising:

a hook end, a terminating end opposite from the hook end, and a butt positioned between hook and terminating end;

a plurality of cams, with each cam comprising first and second cam faces defining a cam track for slidably receiving the butts of some of the needles so that the machine includes a plurality of cam tracks with each track slidably receiving a different subset of the needles, each cam comprising a raising cam portion for moving the needles to a raised position for receiving yams, a stitch cam portion following the raising cam portion for moving the needles to a stitch position for making yarn loops, and a welt cam portion following the stitch cam portion in which tension forces between the yam loops and needle hooks bias the butts of intact needles against the first cam face, and for each cam the welt cam portion comprises:

a detector butt raising segment in which the second cam face is inclined away from the second cam face at the stitch position for contacting butts and urging the butts toward the first cam face, a detector butt lowering segment following the detector butt raising segment and in which the first cam face contacts the needle butts and urges the butts toward the second cam face, a detector recess segment following the detector butt lowering segment and in which the second cam face is sufficiently spaced from the first cam face so that butts of needles having broken hooks are urged into the recess segment by the detector butt lowering segment, but butts of intact needles that are biased against the first cam face do not enter the detector recess segment; and multiple trick channels within which the needles are respectively contained and reciprocate due to relative movement between the trick channels and the cams, with each trick channel comprising opposite first and second ends, with the first end being the end from which the hook end of the needle therein protrudes, and for each needle:

the terminating end thereof is in a first position proximate the second end of its trick channel while the hook of the needle is broken and the butt of the needle is in the detector recess segment, and the terminating end thereof is in a second position proximate the second end of its trick channel while the needle is intact and the butt of the needle is passing by but does not enter the detector recess segment; and a sensor for identifying broken needles carried by any of the cam tracks by sensing terminating ends that are in the first position.

2. A multi-track knitting machine according to claim 1, wherein the sensor does not sense terminating ends that are in the second position.

3. A multi-track knitting machine according to claim 1, further comprising structure for carrying the cams, wherein the sensor is mounted to the structure for carrying the cams.

4. A multi-track knitting machine according to claim 1, wherein the plurality of cam tracks are at least approximately concentric with one another.

5. A multi-track knitting machine according to claim 1, wherein the plurality of cam tracks are positioned one above another.

6. An apparatus for detecting broken hooks of needles in a knitting machine having first and second cam faces defining a cam for slidably receiving needle butts, the cam comprising a raising cam portion for moving the needles to a raised position for receiving yarns, a stitch cam portion following the raising cam portion for moving the needles to a stitch position for making yarn loops, and a welt cam portion following the stitch cam portion in which tension forces between the yam loops and needle hooks bias the butts of intact needles against the first cam face, the apparatus comprising:

a detector butt raising segment in the welt cam portion, wherein the second cam face in the welt cam portion is inclined away from the second cam face at the stitch position for contacting butts and urging the butts toward the first cam face;

a detector butt lowering segment in the welt cam portion following the detector butt raising segment, wherein the first cam face contacts the needle butts and urges the butts toward the second cam face;

a detector recess segment in the welt cam portion following the detector butt lowering segment, wherein the second cam face is sufficiently spaced from the first cam face so that butts of needles having broken hooks are urged into the recess segment by the detector butt lowering segment, but butts of intact needles that are biased against the first cam face do not enter the detector recess segment; and a sensor for identifying needles having needle butts in the detector recess segment, wherein the sensor is positioned outside of the detector recess segment.

7. An apparatus as defined in claim 6, wherein a cam track is defined between the first and second cam faces and the sensor is positioned outside of the cam track.

8. An apparatus as defined in claim 6, wherein the knitting machine further comprises multiple trick channels within which the needles are respectively contained and reciprocate due to relative movement between the trick channels and the cam, wherein each trick channel comprises opposite first and second ends, with the first end being the end from which the hook end of the needle therein protrudes, wherein the sensor is positioned to be activated by portions of broken needles that protrude from proximate the second ends of their respective trick channels.

9. An apparatus as defined in claim 6, further comprising means for stopping operation of the knitting machine when the sensor identifies needles having needle butts in the detector recess segment.

10. An apparatus as defined in claim 6, wherein the knitting machine further comprises structure for carrying the cam, wherein the sensor is mounted to the structure for carrying the cam.

11. An apparatus as defined in claim 6, wherein each needle has a terminating end that is opposite from its hook, and the sensor is for identifying terminating ends of needles having needle butts in the detector recess segment.

12. An apparatus as defined in claim 11, wherein each needle defines a length between its hook and its terminating end, and the terminating end extends generally parallel to the length.

13. An apparatus as defined in claim 11, wherein each needle defines a length between its hook and its terminating end, and the terminating end extends generally perpendicular to the length.

14. An apparatus as defined in claim 6, wherein the sensor comprises a blade that projects to a position that is remote from the cam and which is activated by contact with a portion of a needle that is distant from the butt of the needle.

15. An apparatus as defined in claim 14, wherein the sensor is an electrical switch that is tripped by movement of the blade.

16. A method for identifying broken hooks of needles in a knitting machine, the method comprising:

providing a welt cam having first and second cam faces for controlling the position of needles in a knitting machine so that intact needles are biased against the first cam face by tension forces between the needle hooks and yams;

contacting the needle butts with an inclined portion of the second cam face to urge the butts toward the first cam face;

contacting the needle butts with a declined portion of the first cam face to urge the butts toward the second cam face;

providing a detector recess segment in which the second cam face is sufficiently spaced from the first cam face so that butts of needles having broken hooks enter the recess due to contact with the declined portion of the first cam face;

sensing with a sensor that is positioned outside of the detector recess segment a needle having its butt in the detector recess segment; and stopping operation of the knitting machine when the sensor is actuated.

17. A method as defined in claim 16, wherein the sensing comprises sensing a terminating end of a needle having its butt in the detector recess segment, wherein the terminating end is distant from the butt.

18. A needle for use in a knitting machine to form fabric, the knitting machine comprising a cam, a trick channel for housing the needle and within which the needle can reciprocate due to relative movement between the trick channel and the cam, the trick channel comprising an upper end and a lower end, and a sensor that is sensitive to stimulus at a first position proximate the lower end of the trick channel, the needle comprising:

a hook end for protruding from the upper end of the trick channel;

a terminating end opposite from the hook end; and a butt positioned between hook and terminating ends and for sliding along and being constrained by the cam while the needle is used in the knitting machine, wherein the terminating end is constructed so that the terminating end:

is precluded from being in the first position while the needle is intact and used in the knitting machine to form fabric, and does move into the first position while the needle is used in the knitting machine and the hook end of the needle is broken.

19. A needle as defined in claim 18, wherein the needle defines a length between the hook and terminating ends, and the terminating end extends generally parallel to the length.

20. A needle as defined in claim 18, wherein the needle defines a length between the hook and terminating ends, and the terminating end extends generally perpendicular to the length.

21. A needle for use in a knitting machine to form fabric, the knitting machine comprising a cam, a trick channel for housing the needle and within which the needle can reciprocate due to relative movement between the trick channel and the cam, the trick channel comprising an outer end and an inner end, and a sensor that is sensitive to stimulus at a first position proximate the outer end of the trick channel, the needle comprising:

a hook end for protruding from the inner end of the trick channel;

a terminating end opposite from the hook end; and a butt positioned between hook and terminating ends and for sliding along and being constrained by the cam while the needle is used in the knitting machine, wherein the terminating end is constructed so that the terminating end:

is precluded from being in the first position while the needle is intact and used in the knitting machine to form fabric, and does move into the first position while the needle is used in the knitting machine and the hook end of the needle is broken.

* * * * *

UNITED STATES PATENT AND TRADEMARK OFFICE

CERTIFICATE OF CORRECTION

PATENT NO. : 6,318,132 B1
DATED : November 20, 2001
INVENTOR(S) : Gutschmidt et al.

It is certified that error appears in the above-identified patent and that said Letters Patent is hereby corrected as shown below:

Column 12,
Line 53, “yams” should read -- yarns --;
Line 57, “yam” should read -- yarn --.

Column 13,
Line 48, “yam” should read -- yarn --.

Column 14,
Line 51, “yams” should read -- yarns --.

Signed and Sealed this

Fourth Day of June, 2002

*Attest:*

*Attesting Officer*

JAMES E. ROGAN
*Director of the United States Patent and Trademark Office*